United States Patent [19]

Frostrom

[11] 3,954,083

[45] May 4, 1976

[54] TWIN-PROPELLER STERN DRIVE

[75] Inventor: James K. Frostrom, Mount Juliet, Tenn.

[73] Assignee: The Mocaire Company, Mount Juliet, Tenn.

[22] Filed: Mar. 24, 1975

[21] Appl. No.: 561,201

Related U.S. Application Data

[63] Continuation-in-part of Ser. No. 418,588, Nov. 23, 1973, abandoned.

[52] U.S. Cl. ..... 115/37; 74/665 GB; 115/41 R

[51] Int. Cl.[2] ..... B63H 5/10

[58] Field of Search ..... 115/34 R, 37, 38, 17, 115/18 R, 41, 35; 114/66.5 H; 74/665 GB, 665 H, 665 P, 665 M, 665 L

[56] References Cited

UNITED STATES PATENTS

| | | | |
|---|---|---|---|
| 2,705,468 | 4/1955 | Dix | 115/18 R |
| 2,980,047 | 4/1961 | Korganoff et al. | 114/66.5 H |
| 3,199,483 | 8/1965 | Ellzey | 114/66.5 H |
| 3,354,857 | 11/1967 | Hobday | 114/66.5 H |
| 3,434,449 | 3/1969 | North | 115/41 R |
| 3,456,611 | 7/1969 | Johnson | 114/66.5 H |

*Primary Examiner*—Trygve M. Blix
*Assistant Examiner*—Sherman D. Basinger
*Attorney, Agent, or Firm*—Abram W. Hatcher

[57] ABSTRACT

Twin-propeller stern drive propulsion unit having automatic thrust alignment trim and retractable hydrofoils for improved shallow water operation. Retention of optimum thrust direction is accomplished automatically by parallel geometry action of a cross-plane trim actuator with a vertical drive shaft housing attached to an underwater unit.

3 Claims, 13 Drawing Figures

2
4
6
8
10
12
16
26
27
28
29
38
40
44
46
48
B

TWIN-PROPELLER STERN DRIVE

This is a continuation-in-part of Ser. No. 418,588, filed November 23, 1973, entitled Twin-Propeller Stern Drive, and now abandoned.

BACKGROUND OF THE INVENTION

1. Field of the Invention

This invention relates to marine propulsion. More particularly, it relates to a stern drive propulsion unit which may be powered by a single inboard or outboard engine.

2. Description of the Prior Art

It is well known that a single propeller propulsion unit, whether driven by an inboard or outboard engine, particularly in the higher horsepower ranges, produces undesirable torque and steering characteristics. These require the introduction of offsetting hull and trim features which are not only complex and bulky but also difficult to control in that they are optimum at only one specific design speed. Such offsetting hull and trim features are further undesirable because of their molded-in-hull features, particularly where both single and dual-engine installations of varying horsepower are offered in the same basic hull design. This is at least partly because lower horsepower single-engine, single propeller installations are generally over-corrected. Thus, the maximum horsepower for which currently available hulls are being marketed is being accomodated by the use of dual-engines and dual propellers. This entails considerable extra expense since it requires dual controls, instrumentation and an extra engine and drive unit. Furthermore, a dual-drive unit such as that of U.S. Pat. No. 2,936,730 splits into two drives above the water, steers with hydraulic power, and has no fail-safe mechanism. That is, if the lines are blocked, all steering will fail or become rigidized in opposing directions since hydraulically powered steering of that design is integral with each drive unit and lacks mechanical interconnection to preserve directional alignment of the drive units.

SUMMARY OF THE INVENTION

After extended investigation, I have found that difficulties such as these may be remedied by providing boat propellers which rotate in opposite directions with a single drive unit which employs a single engine in an inboard or outboard outdrive installation, where power output and application require minimization of propeller torque reaction. A single or a divided or multiple cross-shaft to which the propellers are attached is normally positioned at the underwater level. The propellers and shaft housings therefor may be positioned either horizontally or other than horizontally, for example tilted toward the water. According to one embodiment of my invention, a cross-plane, trim actuator is provided to change the angle of attack and direction of thrust of the propellers. According to another, fixed or integral cross-shaft housings are provided with free-floating, self-aligning fairings. The cross-shaft or provision of multiple cross-shafts permits angling of each shaft as desired. The housings contain the drive mechanism for the propellers, can be used to trim the boat by varying the angle of attack when used on a conventional hull, and can be given additional travel so as to act as hydrofoils.

BRIEF DESCRIPTION OF THE DRAWING AND DESCRIPTION OF THE PREFERRED EMBODIMENT

For a better understanding of my invention, reference will now be made to the drawing which forms a part hereof.

Figure 4:
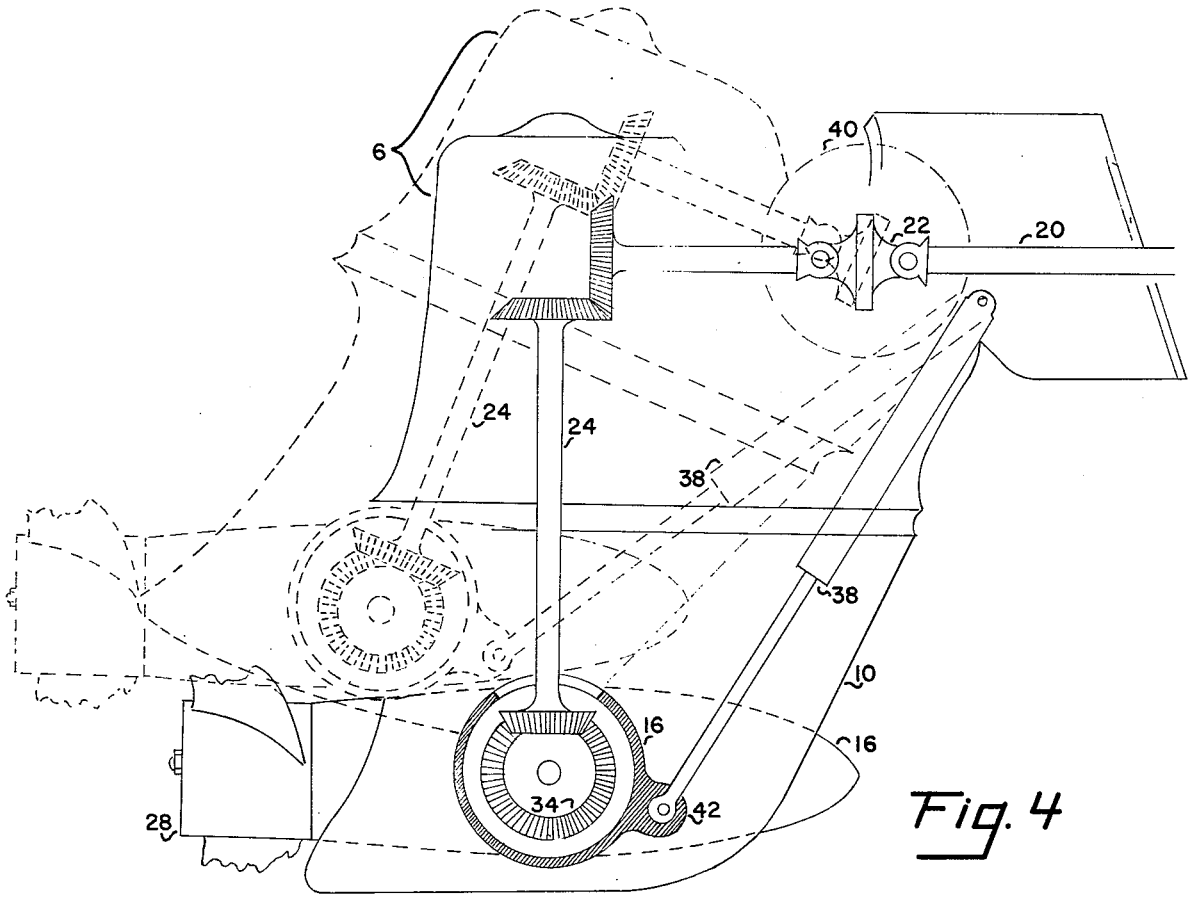
FIG. 4 is a section taken on line 5—5 of FIG. 3, including alternative positioning of the stern drive unit.
Figure 4A:
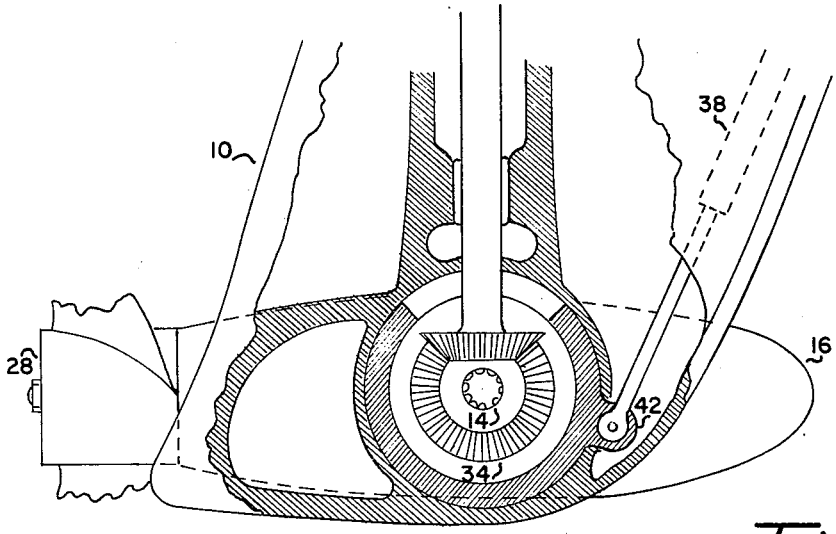

FIG. 4*a* is an enlarged cutaway section of the lower portion of FIG. 4.

Figure 3:
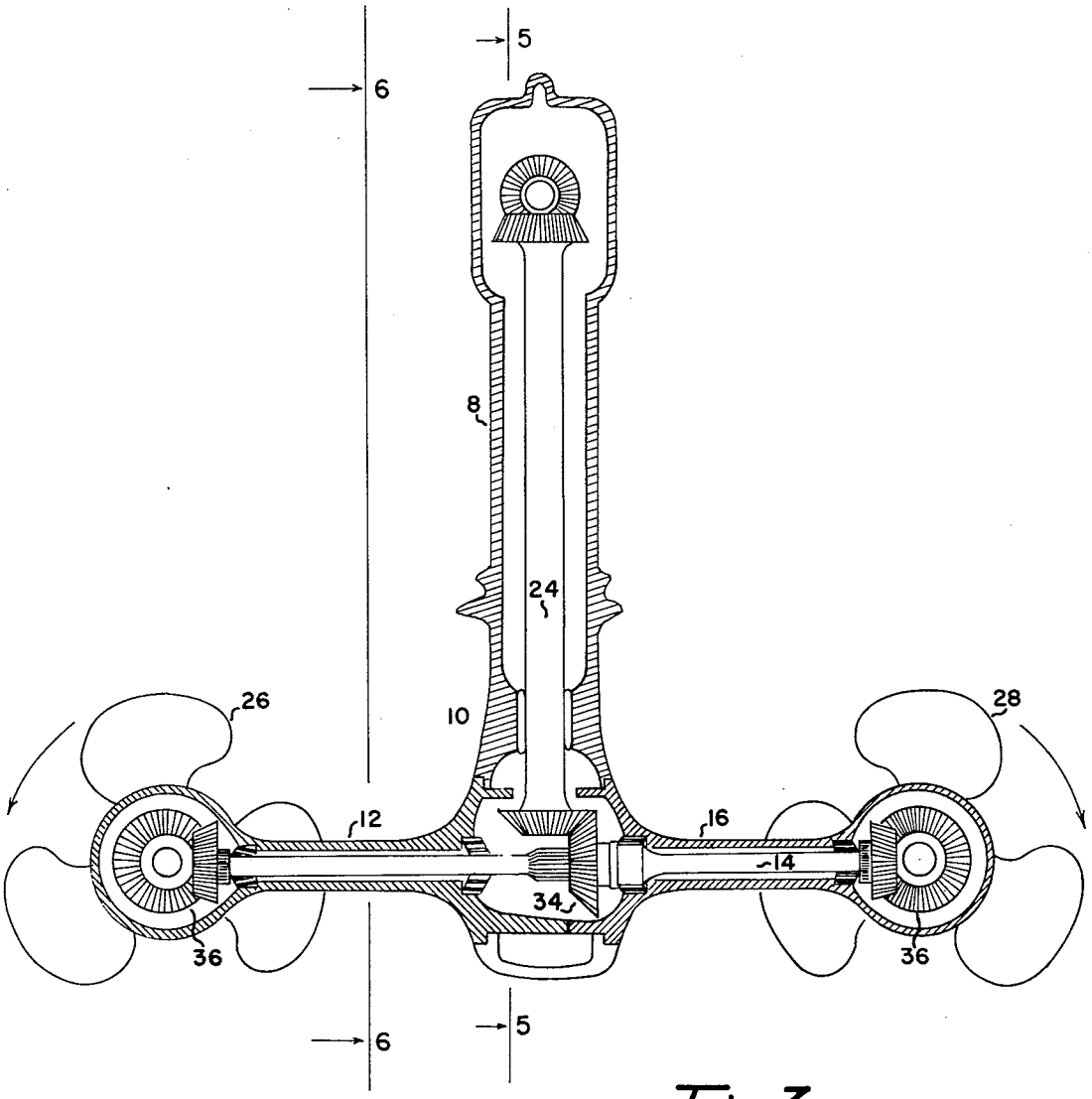
FIG. 3 is a section taken on line 4—4 of FIG. 2.
Figure 5:
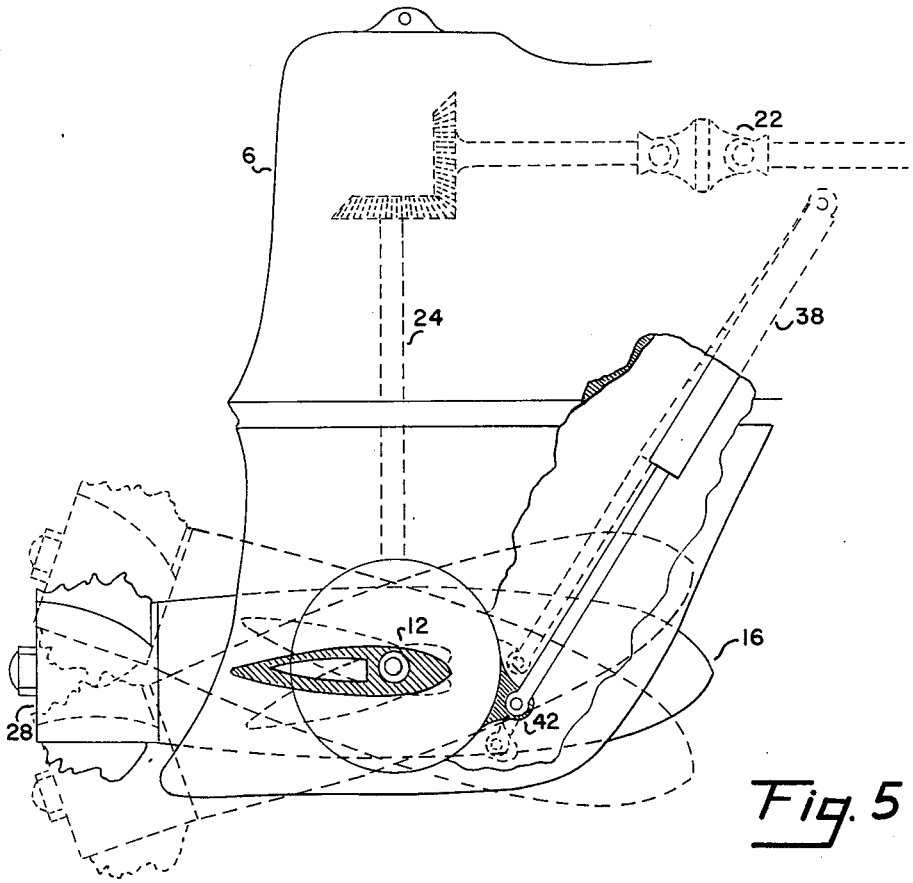

FIG. 5 is a section taken along line 6—6 of FIG. 3, with alternative positions for the propeller unit also shown.

Figure 6:
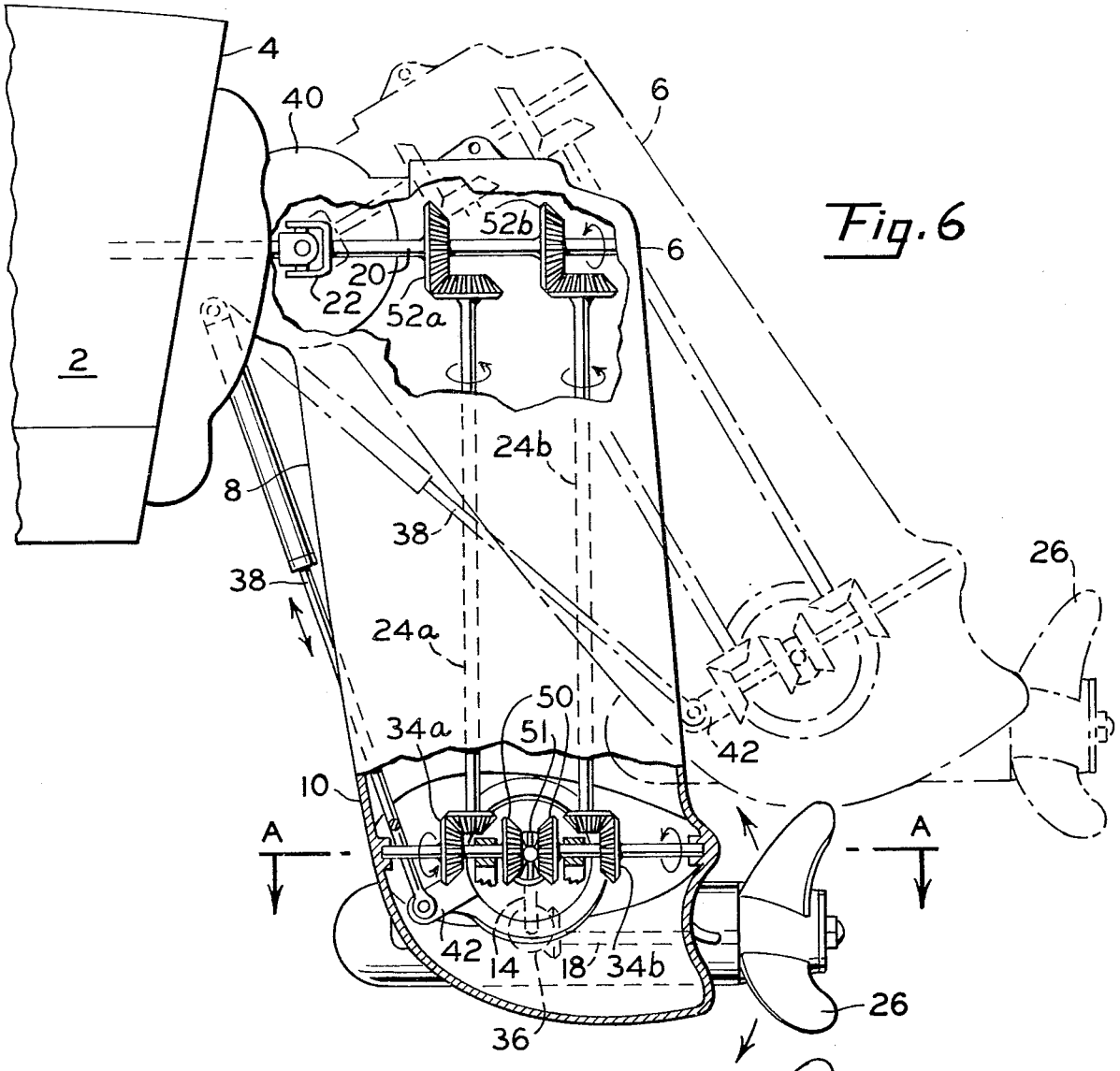

FIG. 6 is a side perspective view showing a separate vertical shaft arrangement for the twin-propeller stern drive unit of the invention wherein the unit is also shown in alternate dotted-line raised form with propeller and shaft maintaining parallel alignment of thrust.

Figure 7:
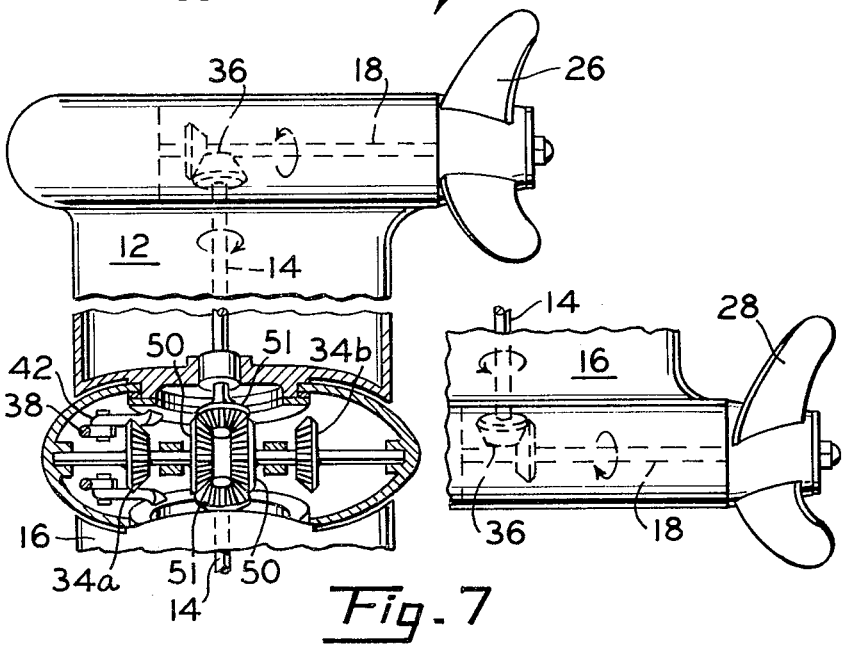

FIG. 7 is a cross-sectional view taken at A—A of FIG. 6 and broken away in three parts showing a bevelled gear operative structure for a dual or divided cross-shaft.

Figures 8, 9, 10, 11:
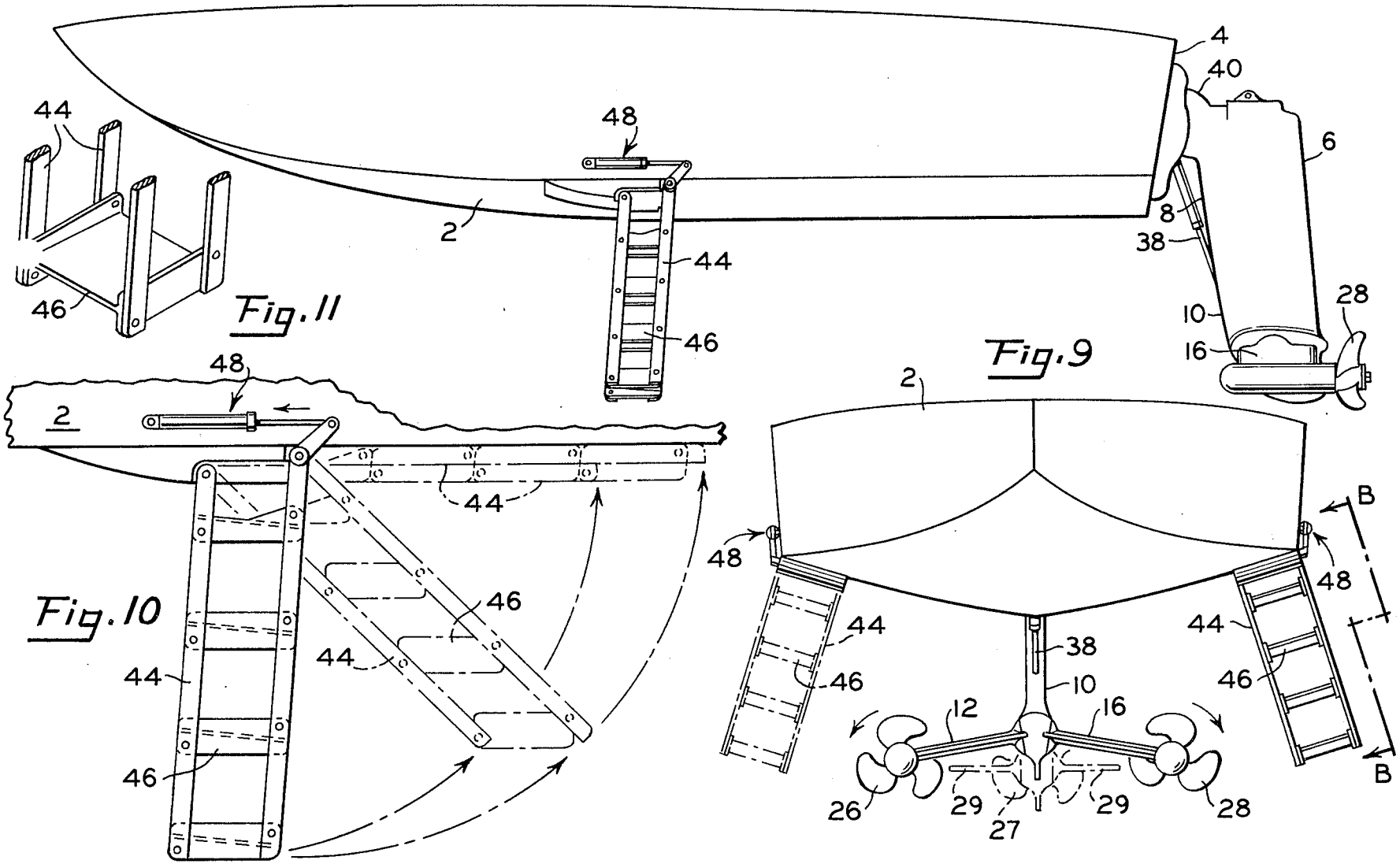

FIG. 8 is a side view of a boat having a twin-propeller stern drive and fail-safe hydrofoils according to the invention.

FIG. 9 is a rear view of a boat such as that of FIG. 8 wherein is shown, in addition to other features indentified in more detail hereinbelow, a single propeller 27 with rear or aft hydrofoils 29, which cooperate with fore or front hydrofoils 44 to eliminate drag and raise the hull out of the water.

FIG. 10 is a blown-up view taken at angle B—B of FIG. 9 showing in more detail a hydrofoil such as shown in FIGS. 8 and 9 and, schematically, how it may be retracted to fit into position along the contour of the boat.

FIG. 11 is an enlarged view, broken away, of a portion of a hydrofoil such as used with the boat of FIGS. 8 and 9.

Figure 12:
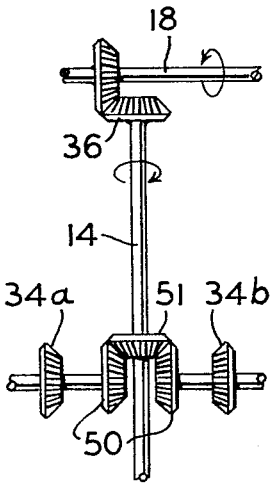

FIG. 12 is a view of a single cross-shaft embodiment of the 2-vertical shafts system of FIGS. 6 and 7 except for having a straight shaft arrangement rather than an angled one such as shown in FIG. 9.

Figure 1:
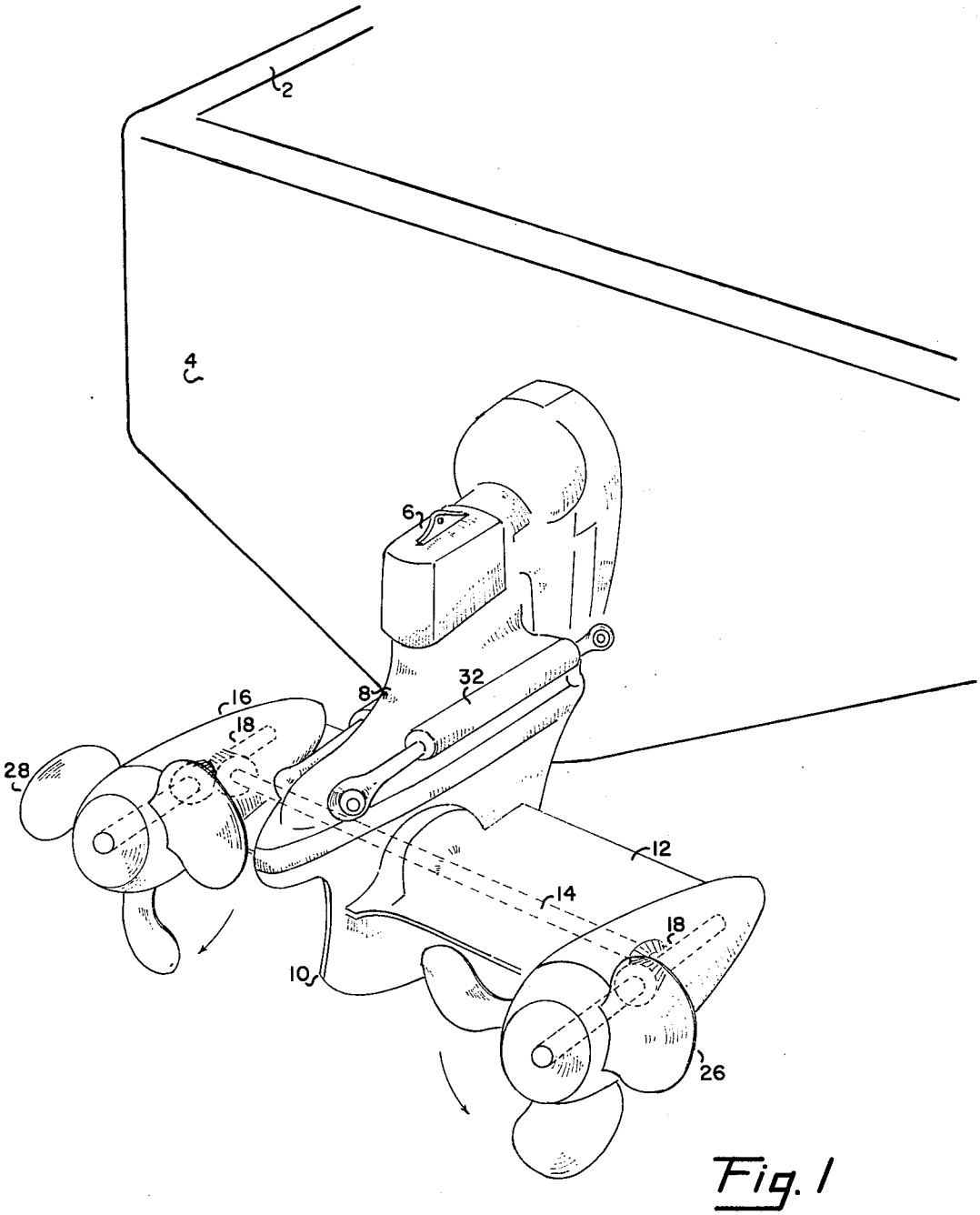
FIG. 1 is a perspective view, partially broken away, of the stern of a boat equipped with a twin-propeller stern drive unit embodying features according to the present invention.
Figure 2:
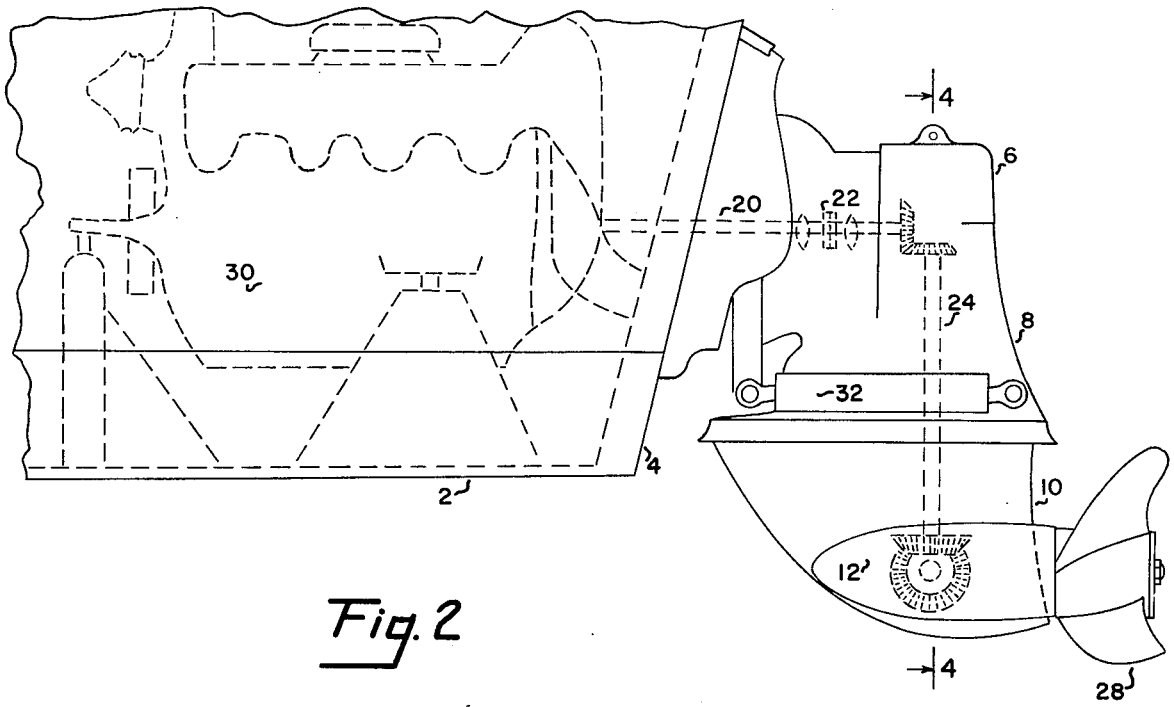
FIG. 2 is a partial side elevation view of a boat with a representative inboard engine and an outboard stern drive unit of the invention.

Referring now to FIG. 1, with incidental reference to the side elevation view of FIG. 2 and the cross-sectional view of FIG. 3, boat 2 has a rear transom 4 upon which is mounted twin-propeller outboard stern drive 6. Drive 6 comprises a vertical drive shaft 24 which extends into an underwater unit 10. Through right-angle bevel gears 34, a horizontal cross-shaft 14 rotates two horizontal propeller shafts 18 in opposite directions through outer sets of bevel gears 36. Thus, propellers 26 and 28 are also turned in opposite directions of rotation. This effectively cancels any propeller torque reaction and doubly eliminates the need for torque off-setting design features in the hull and for conventional vertical trim tabs on the stern drive unit.

Propeller shaft housings, which are embodied as integral with the cross-shaft housings 16 with self-aligning fairings 12 are set apart substantially horizontally from the center. Underwater unit 10, which would ordinarily contain a propeller drive housing rigidly encased therein, because of this setting apart, allows separate construction of the propeller and cross-shaft housings 12 and 16. Attachment of housings 12 and 16 to underwater unit 10 on a sealed circular plane facilitates incorporation of additional features such as those depicted in FIGS. 4 and 5 described hereinafter.

In FIG. 4 is illustrated the retention of propeller thrust in the optimum direction, that is, substantially parallel to the waterline and direction of travel when stern drive unit 6 is tilted upward by actuation of trim cylinders 32 for shallow-water running. This retention of optimum thrust direction is accomplished automatically by the parallel geometry action of cross-plane trim actuator 38 having upper and lower attach points of the ends thereof with the vertical drive shaft housing 8 having an upper pivot point attached to underwater unit 10. Alternatively, a fixed non-adjustable rod can also maintain the thrust-alignment of cross-plane housings 12 and 16 which have operating pivot points, by the establishment of the parallel-link geometry of cross-plane trim actuator 38 with vertical driveshaft 24. They remain aligned as underwater unit 10 is raised and pivoted and/or steered by rotating about an upper universal joint housing 40. Thrust alignment is maintained by the parallelogram relationship of cross-plane trim actuator 38 to the upper housing 6 pivot point and the cross plane housing 12 and 16 pivot points when drive unit 6 is rotated fore and aft to adjust for drive unit depth in the water.

In FIG. 5, cross-plane trim actuator 38 is shown as it raises or lowers a control arm 42, which is integral with, or mounted to, cross-plane pivot structures 12 and 16 so as to change their angle of attack as well as the direction of thrust from propellers 26 and 28. This permits a boat operator to trim the propulsion unit for best performance, thereby enabling the boat to have the best running angle, since the stern will raise or lower in response to in or out inputs to trim-actuator 38. This also eliminates the necessity for separate trim tabs such as those frequently installed on boats using all types of propulsion, inboard, or outboard and stern drive, to alter the running angle to achieve optimum performance. Because of the above-described parallel-link geometry, the optimum cross-plane trim angle remains constant when stern drive unit 6 is raised for shallow-water operation or to optimize the relationship of hull 2 to propellers 26 and 28 and drive-shaft housings 12 and 16. Additional cross-plane trim inputs can be made at any point within the running range of the propulsion unit.

In FIGS. 6 and 7 separate vertical drive shafts **24*a* and 24*b* are tied in to divided cross-shaft 14 with associated bevelled gear 51 via right-angle bevelled gears 50 and auxiliary fore and aft shafts 34*a* and 34*b* so as to turn propeller 26 via propeller shaft 18 with associated bevelled gears 36, and to universal joint 22 by right-angle bevelled gears 52*a* and 52*b* and horizontal drive shaft 20**.

In FIGS. 8 and 9 are depicted on boat 2 a novel ladder-like hydrofoil 44 (corresponding to one on the other side of the boat not shown) with step-type cross-bars 46 and a retraction mechanism 48 (here shown pressure cylinder-operated) for pulling up the hydrofoil 44 to conform substantially to the shape of bottom portion of boat 4 so as to be out of the way and non-obstructive when not in use.

In addition to improved shallow-water operation and maintenance of thrust alignment, my stern drive provides a fail-safe improved bevelled gear mechanism whereby both propellers are enabled to continue to operate if a single part such as one of the two vertical shafts depicted in FIG. 6 should fail.

Further advantages of the invention include:

1. elimination of the necessity of having offsetting hull and trim structure
2. elimination of separate controls such as normally required when more than one propeller is used
3. minimizing of propeller torque reaction
4. permiting cross-plane, trim actuation without elaborate structural modification
5. allowing variation in propeller angle of attack and elevation of thrust
6. enabling a stern drive to be operated in shallow water with maintenance of propeller thrust alignment or parallelism
7. double steerability An additional advantage of my invention is that the housings are so constructed that, by containing the drive mechanism of the twin propellers, they can be used not only to move a boat but also to trim it by varying the angle of attack when used on a conventional hull. The stern drive of the invention can also be given additional travel so as to act as a hydrofoil, especially when forward hydrofoils such as those shown in FIGS. 8 – 11 are employed. Furthermore, the hydrofoils of the invention are fail-safe as well as self-balancing and do not require outside room to retract. The partially submerged hydrofoil 44 having multiple steps 46, is inherently stable or self balancing since deeper submersion brings more of the forward hydrofoil steps 46 into contact with the water, thus tending to rise to a nominal load balance condition and automatically level the foil-borne craft 2 laterally.

A still further advantage of the dual-propeller stern drive of the invention is that no separate mechanism is required for maintaining parallelity. Trim means such as cross plane trim actuator 38 automatically provide thrust parallelism according to the invention when propeller tilt means such as trim cylinders 32 permit tilting upward for shallow water running.

While depicted in the foregoing description as applied to an outboard stern drive for boats, the propulsion unit of this invention is adapted for use in outboard motor drives and other drives where substantially right-angle bevelled gears are employed.

While the invention has been described in terms of preferred embodiments, the claims appended hereto are intended to encompass all embodiments which fall within the spirit of the invention.

Having thus described my invention:

1. A twin-propeller stern drive comprising twin propellers adapted to rotate in opposite directions, said propellers connected by means of a cross-shaft to at least one vertical shaft by means of gears, said at least one vertical shaft being adapted for joining to a single horizontal drive, said shafts and gears being contained within a housing therefor, one of said propellers being on one side of said at least one vertical shaft and the other on the opposite side, said shaft with propellers connected thereto being positioned so as to operate normally below the waterline and to automatically maintain thrust alignment of said propellers when the twin-propeller stern drive moves upward or downward, the cross-shaft comprising a divided cross-shaft, each of the two divisions thereof being connected by bevel gears to two separate horizontal shafts adapted to turn in opposite directions, said horizontal shafts each connected through bevel gears to its own separate vertical shaft, both of the separate vertical shafts being connected by bevel gears to a single drive shaft.

2. The twin-propeller stern drive of claim 1 wherein the cross-shaft housing is angled so as to not be substantially perpendicular to the vertical shaft housing.

3. A twin propeller stern drive comprising twin propellers adapted to rotate in opposite directions, said propellers connected by means of a cross-shaft to at least one vertical shaft by means of gears, said at least one vertical shaft being adapted for joining to a single horizontal drive, said shafts and gears being contained within a housing therefor, one of said propellers being on one side of said at least one vertical shaft and the other on the opposite side, said shaft with propellers connected thereto being positioned so as to operate normally below the waterline and to automatically maintain thrust alignment of said propellers when the twin-propeller stern drive moves upward or downward, the cross-shaft comprising a single cross-shaft connected by right-angle bevelled gears through an intermediate horizontal shaft to two vertical shafts both connected by gears to a single drive shaft and universal joint.

* * * * *